United States Patent [19]

Marschka

[11] 4,344,015

[45] Aug. 10, 1982

[54] SCREEN CONTACT MEANS FOR A CATHODE RAY TUBE

[75] Inventor: Frank D. Marschka, Lancaster, Pa.

[73] Assignee: RCA Corporation, New York, N.Y.

[21] Appl. No.: 179,154

[22] Filed: Aug. 18, 1980

[51] Int. Cl.[3] ..... H01J 29/28; H01J 29/88; H01J 29/90

[52] U.S. Cl. ..... 313/466; 313/477 HC; 313/479

[58] Field of Search ..... 313/479, 477 HC, 466, 313/477 R, 461

[56] References Cited

U.S. PATENT DOCUMENTS

| | | | |
|---|---|---|---|
| 3,432,803 | 3/1969 | Nice . | |
| 3,876,898 | 4/1975 | Davis et al. | 313/479 X |
| 3,876,899 | 4/1975 | Davis et al. | 313/482 |
| 3,898,510 | 8/1975 | Davis et al. | 313/479 X |
| 4,182,974 | 1/1980 | Van Ijzeren | 313/481 |

*Primary Examiner*—Palmer C. Demeo

*Attorney, Agent, or Firm*—E. M. Whitacre; G. H. Bruestle; V. J. Coughlin, Jr.

[57] ABSTRACT

A cathode ray tube comprises an envelope having a funnel portion with an electrical terminal extending through a wall surface thereof. A faceplate is sealed to the funnel portion and a screen contact assembly provides electrical contact between the electrical terminal and an aluminum coating on an inside surface of the faceplate. The screen contact assembly includes a conductive strip attached at one end to the electrical terminal. At the other end of the strip and attached thereto is a relatively flexible first contact member which is in pressured electrical contact with the aluminum layer on the faceplate. Disposed between the flexible first contact member and the aluminum layer on the faceplate is an oxidized, silver plated NICHROME foil member of high electrical conductivity. Transverse support and lateral stability is provided by a relatively flexible second contact member attached to and forming a part of the screen contact assembly.

5 Claims, 4 Drawing Figures

SCREEN CONTACT MEANS FOR A CATHODE RAY TUBE

BACKGROUND OF THE INVENTION

The invention relates to a screen contact assembly for a cathode ray tube and particularly to a structure for bridging a frit seal joining a faceplate to a funnel portion of such a tube.

One piece envelopes for cathode ray tubes are well known in the art; however, such envelopes pose problems that are not present in envelope assemblies comprising a funnel portion and a separate faceplate. For example, when an aluminum layer is evaporated on a phosphor screen of a one piece envelope it is necessary to position the aluminum evaporators a few inches from the phosphor screen in order to direct the aluminum onto the screen surface. At such a close distance the aluminum evaporation tends to be nonuniform thus providing a much thicker aluminum coating on the central portion of the screen, which is close to the evaporators, than at the edge of the screen. This aluminum nonuniformity decreases the effective phosphor efficiency of the central portion of the screen by absorbing energy from the incident electron beam. Furthermore, at the close evaporation distance described above, aluminum particles are sputtered from the evaporators and cling to the surface of the screen thus causing spot rejects.

It is therefore desirable to fabricate and inspect the faceplate of the cathode ray tube, including deposition of the aluminum layer onto the phosphor screen, before sealing the faceplate to the funnel portion of the envelope assembly. This can be done only if the phosphor screening and aluminizing operations are performed on a faceplate which is separate from the funnel and which is then sealed, for example, by frit sealing, to the funnel portion of the envelope. However, frit sealed structures pose problems in that it is necessary to electrically connect the aluminum layer which overlies the phosphor screen to a source of electrical potential.

It is known in the art to connect the aluminum layer on the phosphor screen to the conductive coating on the inside of the funnel, for example, by painting a conductive stripe or evaporating a conductive material over the frit seal; however, such structures are unreliable especially where the frit seal is reentrant causing the conductive striping or coating to become discontinuous. In applications where peak electrical currents in the 2 to 3 milliampere range are experienced, it is also necessary to have an electrical connecting structure which can withstand such high currents.

U.S. Pat. No. 3,432,803 to Nice, issued Mar. 11, 1969, shows a "through the frit" structure providing electrical contact between an external high voltage lead and the aluminum layer on the phosphor screen of the cathode ray tube. U.S. Pat. No. 3,898,501 to Davis et al. issued Aug. 5, 1975, also shows a "through the frit" type of connection. Both the Nice and the Davis et al. structures introduce mechanical stresses in the frit seal area and thus are unreliable structures for providing the proper voltage to the screen of the cathode ray tube.

U.S. Pat. No. 3,876,899 to Davis et al. issued Apr. 8, 1975, discloses an electrical connective member which bridges the frit seal of the cathode ray tube and contacts the aluminum layer that extends along a longitudinal portion of the sidewall of the faceplate assembly. The connective member is disclosed to have a forward contact area formed to have a substantially reverse-turned leading edge or turned-under rounded terminal end having a thickness of about twice the thickness of the body of the conductive member. The rounded turned-under terminal end is located to effect slidable pressured contact to the aluminum layer which forms a tab extending along the sidewall of the faceplate assembly.

The connective member of the Davis et al. U.S. Pat. No. 3,876,899 must be carefully formed to insure that it does not contact the viewing portion of the faceplate since the rounded turned-under terminal end of the connective member is non yielding in the longitudinal direction and would rupture the aluminum layer on the viewing surface of the phosphor screen.

In cathode ray tubes such as projection tubes, the faceplate is sealed directly to the funnel portion of the envelope. In such tubes there is no longitudinally extending sidewall portion of the faceplate and thus the aluminum layer on the screen terminates adjacent to the sealing edge of the faceplate. The Davis et al. connective structure cannot be used in such a tube since the rounded terminal end of the connective member would rupture the aluminum screen coating and break the electrical connection to the screen.

SUMMARY OF THE INVENTION

Screen contact assembly means for a cathode ray tube comprises a conductive strip having attached thereto a relatively flexible first contact member. The screen contact assembly means extends between an electrical terminal within a funnel portion of the tube and an aluminum conductive layer disposed on a faceplate of the tube. A relatively flexible second contact member provides lateral support for the relatively flexible first contact member. A conductive foil member is attached to the screen contact assembly means and is disposed between the relatively flexible first contact member and the aluminum conductive layer.

DESCRIPTION OF THE PREFERRED EMBODIMENT

Figure 1:
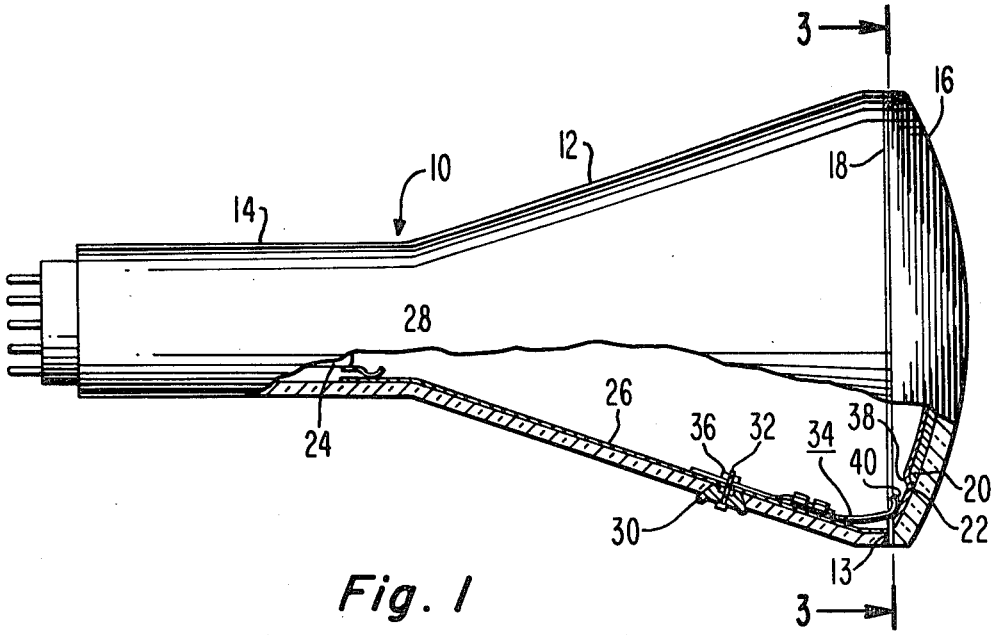
FIG. 1 is a partial broken away longitudinal view of a cathode ray tube incorporating the present novel structure.

Referring to FIG. 1 there is shown a cathode ray tube such as a projection tube, comprising an evacuated envelope designated generally by the numeral 10, which includes a funnel portion 12 having a seal land 13 at one end and a neck portion 14 at the other end. An outwardly curved faceplate 16 is joined to the funnel by a seal 18, preferably of devitrified glass. A luminescent layer 20 of phosphor material is disposed on a portion of an interior surface of the faceplate 16. The composition of the luminescent layer 20 may be any type of phosphor structure well known in the art; however, in a projection tube the phosphor material should emit one of the basic colors, i.e., either red, blue or green. A light reflecting metal coating 22 of aluminum is evaporated onto the luminescent layer 20 and on at least a portion of the remaining area of the faceplate not covered by the layer 20. The layer 20 when scanned by an electron beam from a gun in a mount assembly 24 located in the neck 14, is capable of producing an illuminated image. The layer 20 and the light reflecting metal coating 22 constitute the screen of the tube.

An electrically-conductive coating 26, such as iron oxide, is disposed on a portion of the interior surface of the funnel 12 between the mount assembly 24 and the seal land 13. A plurality of metal fingers 28 (only one is shown) space the mount assembly 24 from neck 14 and connect the forward portion of the mount assembly 24 with the internal coating 26.

An anode button 30 provides an electrical terminal which extends through a wall surface of the funnel 12 adjacent to but spaced from the seal 18. A stud 32 projects inwardly from the anode button 30. A screen contact assembly 34 bridges the seal 18 and extends from the anode button to the aluminum coating 22 on the faceplate 16. A proximal end of the screen contact assembly 34 is attached, for example, by a locking nut 36 to the stud 32 in the anode button 30. In the fabrication of the envelope assembly the aforementioned screen contact assembly 34 is attached as described above before the frit seal 18 is made. This permits the faceplate 16 to be screened, aluminized, and inspected prior to the assembly of the faceplate to the funnel.

Figure 2:
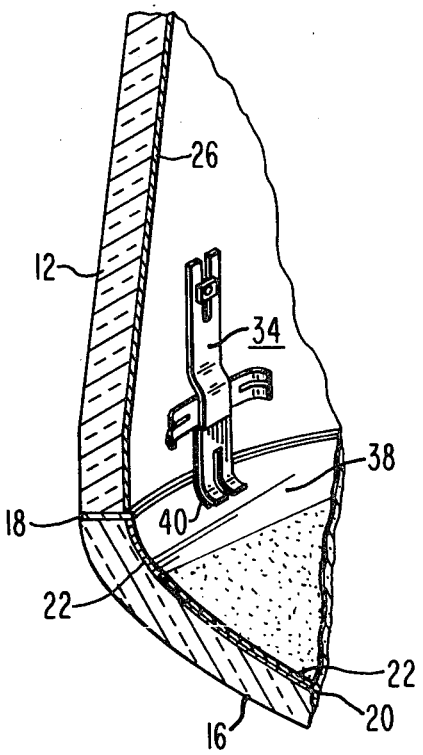
FIG. 2 is an enlarged perspective view showing a portion of the tube incorporating the novel screen contact assembly.

As shown in FIGS. 1 and 2 the screen contact assembly 34 contacts the aluminum layer 22 in an area of the faceplate 16 where there is no phosphor screen 20. The absence of the phosphor screen in the contact area designated 38 in FIG. 1 and 2 provides a hard, positive electrical contact which is capable of carrying high anode currents which normally average 500 microamperes but which may approach 2 to 3 milliamperes of peak current. To improve the electrical contact between the screen contact assembly 34 and the contact area 38 of the screen, a foil member 40 made from an alloy consisting of 80% nickel and 20% chromium sold under the trademark NICHROME and having an oxidized silver plated coating thereon, the foil member having a thickness of about 0.001 inches (0.0254 mm), is attached to the screen contact assembly 34 and extends between the screen contact assembly 34 and the contact area 38.

Figure 3:
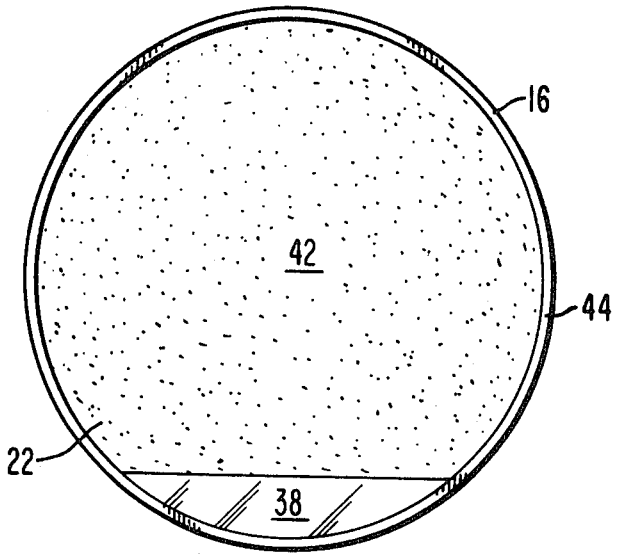
FIG. 3 is a view along line 3—3 of FIG. 1 showing the screen contact area.

As shown in FIG. 3, the faceplate 16 comprises a viewing portion 42, the electrical contact portion or area 38, and a sealing surface 44. While the contact area 38 is shown as a segment of the circular faceplate 16, it should be clear to one skilled in the art that the contact area 38 may take any shape, for example, rectangular, square, triangular, or circular.

Figure 4:
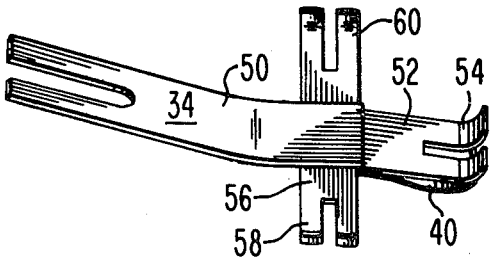
FIG. 4 is an elevated perspective view of the screen contact assembly and foil member attached thereto.

As shown in detail in FIG. 4, the novel screen contact assembly 34 of the present invention comprises a relatively stiff conductive strip 50 of stainless steel having a thickness of about 0.020 inches (0.508 mm). A relatively flexible contact member 52 also made of stainless steel and having a thickness of about 0.005 inches (0.127 mm) is fixedly attached at one end thereof to a distal end of the conductive strip 50. The flexible contact member 52 extends across the seal 18. A distal end 54 of the contact member 52 is bifurcated so as to form a pair of contact surfaces which are embossed in such a manner as to upturn and inwardly direct the contact surfaces to permit sealing of the outwardly curved faceplate 16 to the funnel 12 without damage to the aluminum layer on the contact areas 38 of the faceplate. A relatively flexible transverse member 56 is disposed orthogonal to and attached at its midpoint to the stainless steel strip member 50. The transverse member 56 is an elongated element which provides lateral stability to the conductive strip 50 and is formed in a manner similar to that described for the distal end 54 of the flexible member 52. The transverse member 56 contacts the conductive coating 26 on the funnel 12. The transverse member 56 is shown as having embossed, inwardly directed and upturned contact surfaces formed in a pair of bifurcated distal ends 58 and 60; however, any similar type of structure including dimpling or embossing of the ends 58 and 60 may also be used to provide a spring pressure contact to the conductive coating 26.

The NICHROME foil member 40 is shown in FIG. 4 to be attached to the screen contact 34 so that when the foil member 40 is disposed in the tube 10 it will be located between the layer of aluminum 22 on the contact area 38 and the contact surfaces formed in the bifurcated distal end 54 of the flexible member 52. While the highly conductive, oxidized, silver plated NICHROME foil member 40 is shown to be located only between the flexible contact member 52 and the aluminum screen, similar silver plated NICHROME foil members (not shown) may also be located on the distal ends 58 and 60 of the transverse member 56 to improve the electrical contact between the ends of the transverse member 56 and the conductive coating 26 on the funnel 12.

What is claimed is:

1. A cathode ray tube including an envelope comprising a funnel portion and a faceplate sealed together with a frit seal, an electron gun within a neck portion of said funnel, an electrical terminal extending through said funnel adjacent to said seal, a conductive coating on the interior surface of said funnel, a phosphor screen layer on a first portion only of said faceplate, an aluminum conductive layer on said phosphor screen layer and on at least a portion of the remaining area of said faceplate not covered by said phosphor screen, that portion of said aluminum layer on said remaining faceplate portion constituting a contact area for said phosphor screen, a screen contact assembly comprising:

(a) a relatively stiff conductive strip member attached at a proximal end thereof to said terminal with a distal end thereof being disposed adjacent to said contact area of said aluminum layer, (b) a first relatively flexible contact member attached at a proximal end thereof to said distal end of said strip member, and (c) a second relatively flexible contact member comprising an elongated element disposed orthogonally to and attached at its midpoint to said strip member, said second contact member having two distal ends which are in spring pressure contact with said conductive coating on said funnel; and a foil member attached to said screen contact assembly and pressed against said contact area of said aluminum layer by spring pressure of said first flexible contact member.

2. The tube as in claim 1 wherein said first contact member includes a pair of embossed, upturned and inwardly directed contact surfaces formed in a bifurcated distal end of said first member.

3. The tube as in claim 1 wherein said second contact member includes a pair of embossed, upturned and inwardly directed contact surfaces formed in a pair of bifurcated distal ends.

4. The tube as in claim 1 wherein the foil member comprises NICHROME having an oxidized silver plated layer thereon.

5. A cathode ray tube comprising an envelope having an electron gun sealed to one end of a funnel portion, said funnel portion having a seal land at the opposite end thereof;

an electrical terminal extending through said funnel portion adjacent to said seal land and spaced therefrom;

a conductive coating disposed on an interior surface of said funnel portion, said coating extending from said electron gun to said seal land;

a faceplate sealed to said funnel portion by a frit seal;

a phosphor screen layer disposed on a first portion only of an interior surface of said faceplate;

a layer of aluminum disposed on said phosphor screen layer and on at least a portion of the remaining area of said faceplate not covered by said phosphor screen, that portion of said aluminum layer on said remaining faceplate portion constituting a contact area for said phosphor screen;

a screen contact assembly bridging said frit seal, said screen contact assembly extending from said electrical terminal to said layer of aluminum deposited on said contact area, said screen contact assembly comprising a relatively stiff longitudinal conductive strip member attached at a proximal end thereof to said electrical terminal, a relatively flexible first contact member attached to a proximal end thereof to a distal end of said strip member, said first contact member having a bifurcated distal end forming a pair of embossed, upturned contact surfaces to effect spring pressured electrical connection with said layer of aluminum on said contact areas of said faceplate, said screen contact assembly further including an elongated, relatively flexible second contact member disposed orthogonally to and fixedly attached at the midpoint thereof to said strip member to provide lateral stability to said strip member, said second contact member having two distal ends which are in spring pressure electrical contact with said conductive coating on said interior surface of said funnel assembly; and a NICHROME foil member having an oxidized silver layer thereon, said foil member being disposed between said layer of aluminum and said pair of contact surfaces formed in the bifurcated distal end of said first contact member to improve the electrical connection therebetween, said foil member being attached to said screen contact assembly.

* * * * *